US006961034B2

(12) United States Patent
Kusanagi

(10) Patent No.: US 6,961,034 B2
(45) Date of Patent: Nov. 1, 2005

(54) LIQUID CRYSTAL DISPLAY DEVICE FOR PREVENTING AND AFTERIMAGE

(75) Inventor: Tomohiro Kusanagi, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 8 days.

(21) Appl. No.: 09/767,149

(22) Filed: Jan. 23, 2001

(65) Prior Publication Data

US 2001/0009411 A1 Jul. 26, 2001

(30) Foreign Application Priority Data

Jan. 25, 2000 (JP) ..... 2000-016302

(51) Int. Cl.[7] ..... G09G 3/36
(52) U.S. Cl. ..... 345/87; 345/98; 345/211
(58) Field of Search ..... 345/87, 94, 95, 345/97, 98, 99, 211, 214, 100, 212, 213; 349/33, 34

(56) References Cited

U.S. PATENT DOCUMENTS

| | | | | | |
|---|---|---|---|---|---|
| 5,248,963 | A | * | 9/1993 | Yasui et al. | 345/211 |
| 5,793,346 | A | * | 8/1998 | Moon | 345/211 |
| 5,945,970 | A | * | 8/1999 | Moon et al. | 345/211 |
| 6,005,541 | A | * | 12/1999 | Takahashi et al. | 345/211 |
| 6,323,851 | B1 | * | 11/2001 | Nakanishi | 345/204 |
| 6,326,943 | B1 | * | 12/2001 | Inoue et al. | 345/101 |
| 6,504,534 | B1 | * | 1/2003 | Takase et al. | 345/211 |

FOREIGN PATENT DOCUMENTS

| | | |
|---|---|---|
| JP | A 1-170986 | 7/1989 |
| JP | 2-272490 | 11/1990 |
| JP | A 2-272490 | 11/1990 |
| JP | 4-172493 | 6/1992 |
| JP | U 5-61793 | 8/1993 |
| JP | A 7-13517 | 1/1995 |
| JP | A 8-50274 | 2/1996 |
| JP | 2 655 328 | 5/1997 |
| JP | A 10-214067 | 8/1998 |
| JP | A 11-271707 | 10/1999 |
| JP | A 11-271715 | 10/1999 |
| JP | A 11-282422 | 10/1999 |
| JP | A 2001-22326 | 1/2001 |
| KR | A 1998-040088 | 8/1998 |
| WO | 91/20075 | 12/1991 |

* cited by examiner

*Primary Examiner*—Dennis-Doon Chow
(74) *Attorney, Agent, or Firm*—Young & Thompson

(57) ABSTRACT

The liquid crystal display device includes pixel electrodes; a common electrode; a plurality of data lines and a plurality of gate lines intersecting each other; a plurality of switchers for the pixel electrodes for supplying signals from the data lines to the pixel electrodes; a gate line driver for scanning the gate lines; a data line driver for driving the data lines in accordance with the gradation to be displayed; and a controller for controlling the gate line driver and the data line driver. The controller includes a signal absence detector for detecting that no signal has been input to the liquid crystal display device. The controller outputs a signal to the gate line driver to make all the gate lines active for a predetermined time after the signal absence detector detects that no signal has been input. The controller outputs a signal to the data line driver to supply an electric potential, applied to the common electrode, to all the data lines for the predetermined time.

11 Claims, 5 Drawing Sheets

ACTIVE
NO INPUT SIGNAL
Hr

Hsync

Vsync

POWC

MG

G1
G2
Gn

Si
( i =1～m)
Vcom
GND
T
t1
t2

LIQUID CRYSTAL DISPLAY DEVICE FOR PREVENTING AND AFTERIMAGE

BACKGROUND OF THE INVENTION

1. Field of the Invention

The present invention relates to a liquid crystal display device which improves the problem of an afterimage, and a method for driving the same.

2. Description of the Related Art

When a user stops using and turns off a conventional liquid display device, the device is shut down without any operation for clearing the image on the display. The supply of various signals (scanning line driving signals, data line driving signals, or the like) to the liquid crystal display panel is stopped, and the paths for externally discharging the charge from the liquid crystal capacitance of the liquid crystal display panel is blocked. The charge then gradually decreases because of self-discharge, so that the displayed image is gradually cleared.

However, when the charge is kept in the liquid crystal capacitance for a long time, an afterimage may be produced, the quality of the display and the reliability in use for years may be degraded.

The mechanism for causing the afterimage will be explained.

FIGS. 7A and 7B are schematic diagrams of a unit pixel of the liquid crystal panel in the display device. According to the basic structure of the unit pixel, liquid crystal is enclosed between two electrodes, and a voltage corresponding to the image signal is applied between the electrodes so that the orientation of the liquid crystal molecules is changed. The transmittance of light is thus controlled so as to provide a desired gradation.

When manufacturing the unit pixel, a small amount of ionizable material P may be mixed between the electrodes in step of enclosing the liquid crystal material (see FIG. 7A). Even when the ionizable material P is enclosed, as long as an ideal alternating signal is applied between two electrodes, the material P is not stacked on the electrodes, and does not affect the transmittance of light, that is, the orientation of the liquid crystal molecules.

However, the alternating voltage, which is actually applied to both the electrodes, always contains the component of a direct current. The voltage of the direct current is applied between the electrodes, the ionizable material P is drawn to one of the electrodes because of the characteristics of ion, and is stacked on the electrode as shown in FIG. 7B. When the ionizable material P is stacked on the electrode while the alternating current representing the video image is applied between the electrodes, the voltage applied to the liquid crystal is affected by the ionizable material P stacked on the electrode, and the orientation of the liquid crystal molecules is controlled by the different voltage. When a large amount of ionizable material P is stacked on the electrode, the voltage applied to the liquid crystal is significantly changed, so that the brightness significantly differs from other pixels on which no ionizable material is stacked. This is visually recognized as the afterimage.

To prevent the afterimage, the liquid crystal device disclosed in Japanese Patent No. 2655328 detects the point at which the power is turned off, and directs a power maintaining circuit to maintain turning on switching elements, corresponding to pixel electrodes, for a specified time. Thus, discharging paths are kept opened so that the charge stored in the liquid crystal capacitance can be discharged, and then the liquid crystal display device is turned off.

In general, the sequence of turning off the power to the liquid crystal display device comprises turning off a backlight to prevent the display of the distorted image on the liquid crystal display panel, subsequently stopping sending input signals such as a synchronizing signal, and a video signal, and subsequently turning off the power supply.

While the conventional liquid crystal display device discharges the charge from the liquid crystal capacitance after detecting that the power supply has been turned off, the liquid crystal is charged up in a short time from the stopping the input signals such as the synchronizing signal to the turning-off of the power supply. That is, the direct current is applied to the liquid crystal, decreasing the long-term reliability of the liquid crystal material, and causing the afterimage.

Further, FA (Factory Automation), and monitors, which have been developed in recent years, include a plurality of devices some of which have the liquid crystal display devices. The power to all the devices may be supplied from the same power source. In this case, only the liquid crystal display device cannot be turned off. Therefore, when finishing using the liquid crystal display device, only the input signals are stopped, and the power supply to the liquid crystal display device is not turned off.

Even when the conventional liquid crystal display device, which can discharge the charge from the liquid crystal capacitance at the time of turning off the power supply, is applied to the FA, the charge stored in the liquid crystal capacitance cannot be forcibly discharged.

Therefore, until the charge stored in the liquid crystal capacitance disappears by self-discharge, the direct voltage is continuously applied to the liquid crystal. The ionizable material in the liquid crystal is stacked on the electrodes, thus causing the afterimage.

As mentioned above, even in the conventional liquid crystal display device disclosed in Japanese Patent No. 2655328, as the power supply is repeatedly turned on and off, the ionizable material is stacked on the electrode, the afterimages, or stains are produced, decreasing the life of the liquid crystal, and the reliability in use for years.

BRIEF SUMMARY OF THE INVENTION

It is therefore an object of the present invention to provide the liquid crystal display device which detects absence of an input signal, and forcibly discharges the charge from the liquid crystal capacitance to shorten the time for which the direct current is applied, thereby preventing the occurrence of the afterimage, lengthening the life of the liquid crystal, and improving the reliability, and the method for driving the same.

In a first aspect of the invention, the liquid crystal display device comprises: pixel electrodes; a common electrode; a plurality of data lines and a plurality of gate lines intersecting each other; a plurality of switchers, provided for the pixel electrodes, for supplying signals from the data lines to the pixel electrode; a gate line driver for scanning the gate lines; a data line driver for driving the data lines, in accordance with the gradation to be displayed; and a controller for controlling the gate line driver and the data line driver. The controller comprises a signal absence detector for detecting that no signal has been input to the liquid crystal display device. The controller outputs a signal to the gate line driver to make all the gate lines active for a predetermined time after the signal absence detector detects that no signal has been input. The controller outputs a signal, to the data line driver, to supply an electric potential, applied to the common electrode, to all the data lines for the predetermined time.

The liquid crystal display device determines that no input signal has been input, and then forcibly discharges the charge from the liquid crystal. Therefore, the time for which the display panel is charged up is significantly shortened. As the result, an afterimage can be prevented, and the quality and reliability of the liquid crystal in use for years can be improved.

When the liquid crystal display device of the present invention is employed in a system which does not turn off the power, that is, when the system turns off only the input signal at the time of stopping using the liquid crystal display device while maintaining the power supply, the time for which the display panel is charged up is significantly shortened, as compared with the conventional liquid crystal display which discharges the charge from the liquid crystal capacitance after the power has been turned off.

In a second aspect of the present invention, the predetermined time is a time required to discharge all the charge from the liquid crystal by supplying the common electric potential to all the pixel electrodes.

According to the second aspect of the present invention, the time for driving the gate lines are sufficient to discharge the charge from the liquid crystal capacitance. Therefore, after the charge has been completely discharged from the liquid crystal capacitance, the gate lines are turned off, thereby preventing the afterimage.

In a third aspect of the present invention, the signal is at least a video signal, a horizontal synchronizing signal, or a vertical synchronizing signal.

In a fourth aspect of the present invention, the liquid crystal display device further comprises a power supply maintaining circuit for maintaining power after a power supply to the liquid crystal display device is turned off.

The fourth aspect of the present invention has the power supply maintaining circuit maintains the power supply for a predetermined time even after the power has been turned off, Therefore, even when the power has been turned off before the charge is completely discharged from the liquid crystal capacitance, the power supply maintaining circuit supplies the power to the gate line driver and the data line driver in order to maintain the on-state of the switching elements, and to supply the common electric potential to the pixel electrodes. Thus, the discharging of the charge can be continued, and all the charge can be discharged from the liquid crystal capacitance. As the result, the occurrence of the afterimage can be prevented.

In a fifth aspect of the present invention, the data line driver connects all the data lines to the ground after a power supply to the liquid crystal display device is turned off.

According to the fifth aspect of the present invention, after the power is turned off, the data line driver connects all of the data lines to the ground. Therefore, the data line driver does not require the power, thereby reducing the electric power which the power supply maintaining circuit is to supply.

In a sixth aspect of the present invention, the predetermined time is determined based on a time constant of a resistance and a capacitor.

According to the sixth aspect of the present invention, because the predetermined time is determined based on the time constant of the resistance and the capacitor, even a simple circuit can adjust the time for driving the gate lines and the data lines after no signal has been input, and can easily change the setting values.

In a seventh aspect of the present invention, the method for controlling the liquid crystal display device comprises the steps of: detecting that no signal is input to the liquid crystal display device; making all the gate lines active for a predetermined time after the signal absence detector detects that no signal is input; and supplying an electric potential, applied to the common electrode, to all the data lines for the predetermined time.

DETAILED DESCRIPTION OF THE INVENTION

Figure 2:
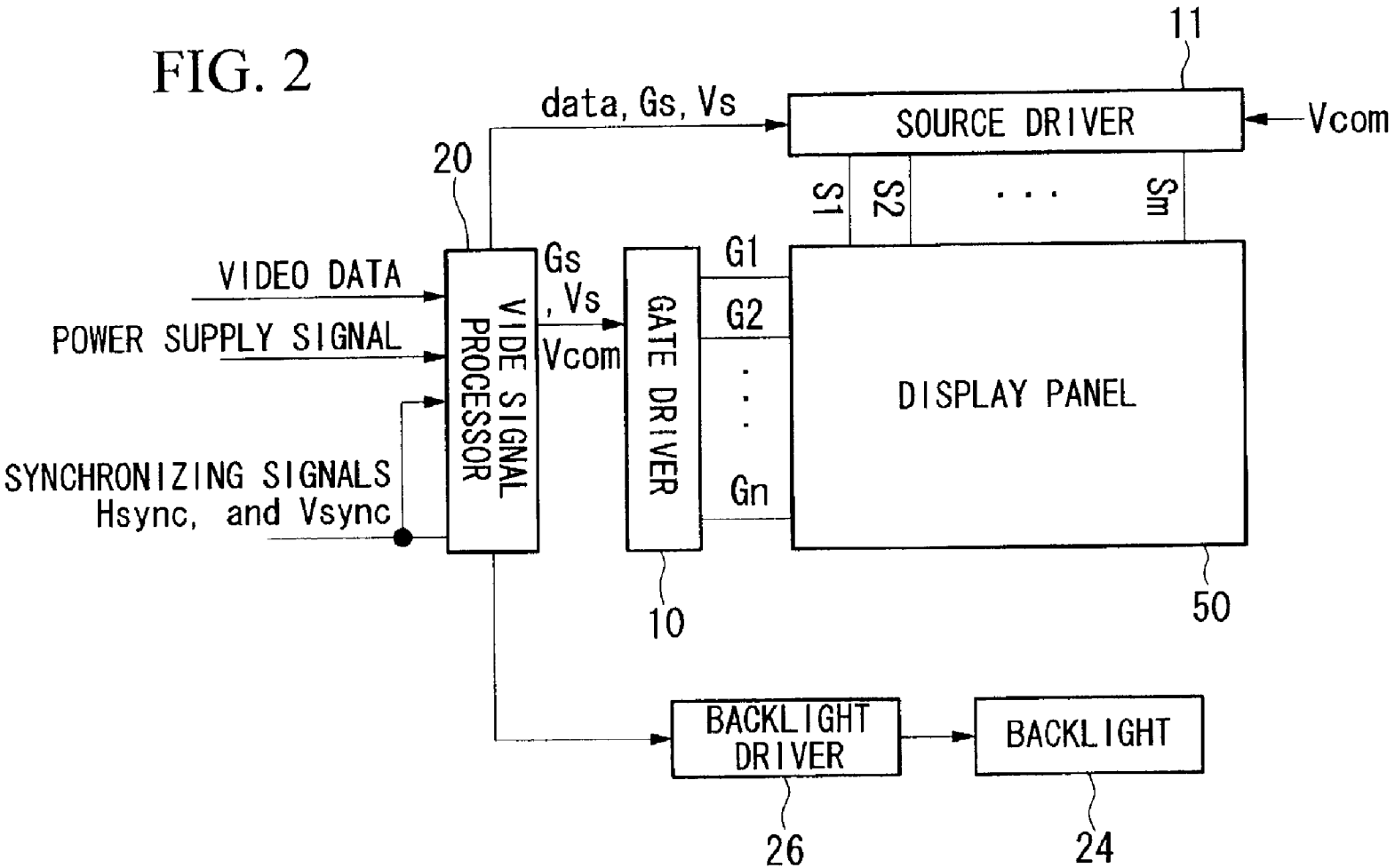
FIG. 2 is a diagram schematically showing the structure of the liquid crystal display device of the present invention.

The embodiment of the present invention will be explained with reference to the figures. FIG. 2 is a block diagram schematically showing the entire structure of the IPS (in-plane-switching) type liquid crystal display device, FIG. 4 is a circuit diagram showing the structure of a unit pixel of a display panel 50, and FIG. 5 is a diagram showing the structure of a unit pixel of the display panel 50.

Figure 4:
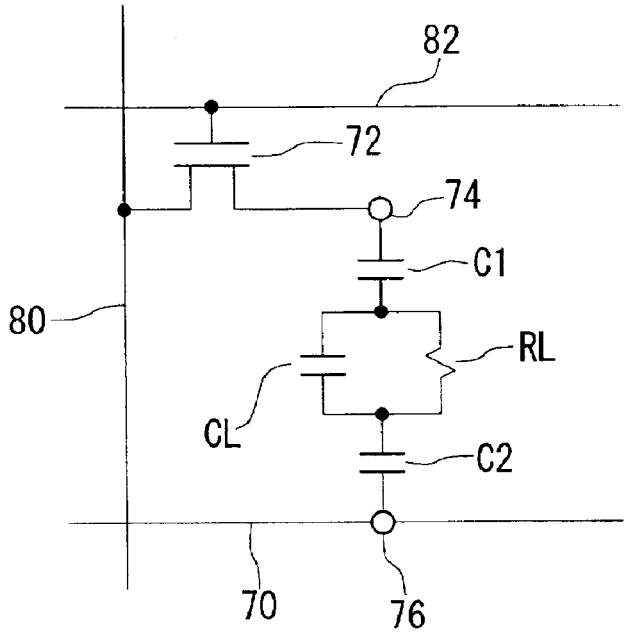
FIG. 4 is a diagram showing the circuit of the unit pixel of the display panel of the present invention.
Figure 5:
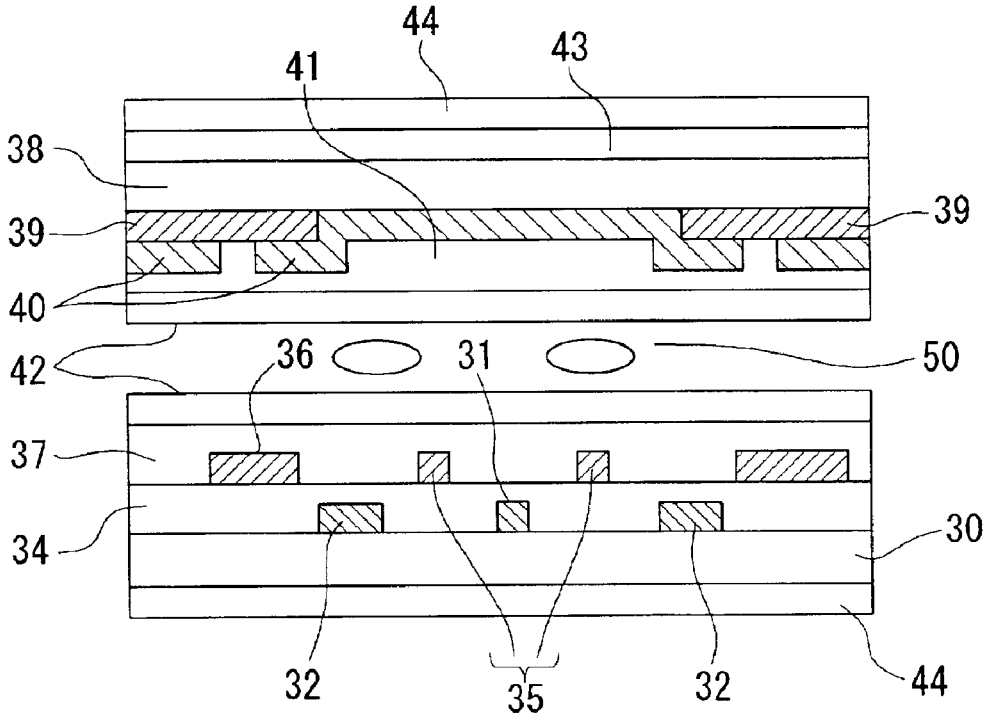
FIG. 5 is a diagram showing the structure of the unit pixel of the display panel of the present invention.

In FIG. 4, reference character CL denotes a liquid crystal capacitance equivalent to a liquid crystal capacitance. Reference character RL denotes a liquid crystal resistance. The parallel circuit of the liquid crystal capacitance CL and a liquid crystal resistance RL is connected through a capacitor C1 to a pixel electrode 74, and is connected through a capacitor C2 to a common electrode 76. The pixel electrode 74 is connected to a source of a thin film transistor (TFT) 72, and the drain of the thin film transistor 72 is connected to a data line 80 for controlling a voltage to be applied to the pixel electrode 74. The gate of the thin film transistor 72 is connected to a gate line 82, and the common electrode 76 is connected to a common electrode line 70.

The capacitances of the capacitors C1 and C2 are provided by contacting the pixel electrode 74 and the common electrode 76, which are on a transparent insulating substrate, with the liquid crystal through an intervening passivation film.

When driving the gate line 82, the thin film transistor 72 is turned on, so that a video signal through the data line 80 is supplied to the pixel electrode 74. Thus, the electric potential difference between the common electrode and the pixel electrode is applied to the liquid crystal capacitance CL. As the result, the orientation of the liquid crystal is changed so that the gradation of the display is achieved.

FIG. 5 shows the structure of the above-described unit pixel. In the figure, the common electrode 31, and common electrode lines 32 connected to the common electrode 31 are formed as patterns on a lower first transparent insulating substrate 30. A gate insulating film 34 is stacked on the common electrode 31 and the common electrode lines 32. The pixel electrode 35 and the data lines 36, connected through the thin film transistor to the pixel electrode 35, are formed as patterns on the gate insulating film 34. A protective film 37 is stacked on the pixel electrode 35 and the data lines 36. An orientation film 42 is formed on the protective film 37. A polarizing plate 44 is attached to the underside (outside) of the first transparent insulating substrate 30.

A black matrix 39 is provided below a second transparent insulating substrate 38. The black matrix 39 acts as a shielding film for preventing incident light through a second transparent insulating substrate 38 from directly entering the thin film transistor, and for preventing leaking of light from the portions between the gate and data lines and the display section which does not contribute to the display function. A color layers 40 are formed as color filters in the black matrix 39. A over coat layer 41 is formed below the black matrix 39 and the color layers 40. The orientation films 42 are located below the over coat layer 41. A transparent conductive film 43 is formed on the second transparent insulating substrate 38. A polarizing plate 44 is attached on the outside of the transparent conductive film 43.

The first and second transparent insulating substrates 30 and 38 on which the electrode layers and the insulating layers are formed are supported at a predetermined distance by spacers, which are not shown, so that the enclosed liquid crystal layer 50 is formed between the orientation films 42. The liquid crystal is made of a material with a comparatively low resistance, e.g., a specific resistance of $10^{12}\Omega\cdot$cm.

Next, the liquid crystal display device with the above-described liquid crystal panel 50 of the present invention will be explained with reference to FIG. 2.

In FIG. 2, reference numeral 20 denotes a video signal processor for generating signals required to display a video image on the display panel 50, based on an video image data input from an external device and on a horizontal synchronizing signal Hsync and a vertical synchronizing signal Vsync. Specifically, the video signal processor 20 generates video signals of R, G, and B corresponding to the respective pixel elements, and a data line driving signal Ds for driving data lines S1 to Sm, from the horizontal synchronizing signal Hsync, and the vertical synchronizing signal Vsync, and supplied the generated signals to a source driver 11. Further, the video signal processor 20 generates a common electrode voltage Vcom which is to be supplied to a common electrode line (not shown), and a gate line driving signal Gs for driving gate lines G1 to Gn, and supplies them to a gate driver 10.

The gate driver 10 drives the gate lines G1 to Gn one by one, based on the gate line driving signals Gs supplied from the video signal processor 20. The source driver 11 drives the data lines S1 to Sm one by one, based on the data line driving signal Ds, while supplying the video signal data from the video signal processor 20 to the data lines S1, S2, . . . .

Reference numeral 24 denotes a back light for emitting light from the back of the liquid crystal panel 50. Reference numeral 26 denotes a back light driving circuit for controlling the back light 24, based on a signal supplied from the video signal processor 20.

In the display panel 50, the unit pixels shown in FIG. 4 are arranged in a matrix (with n rows, and m columns).

Figure 1:
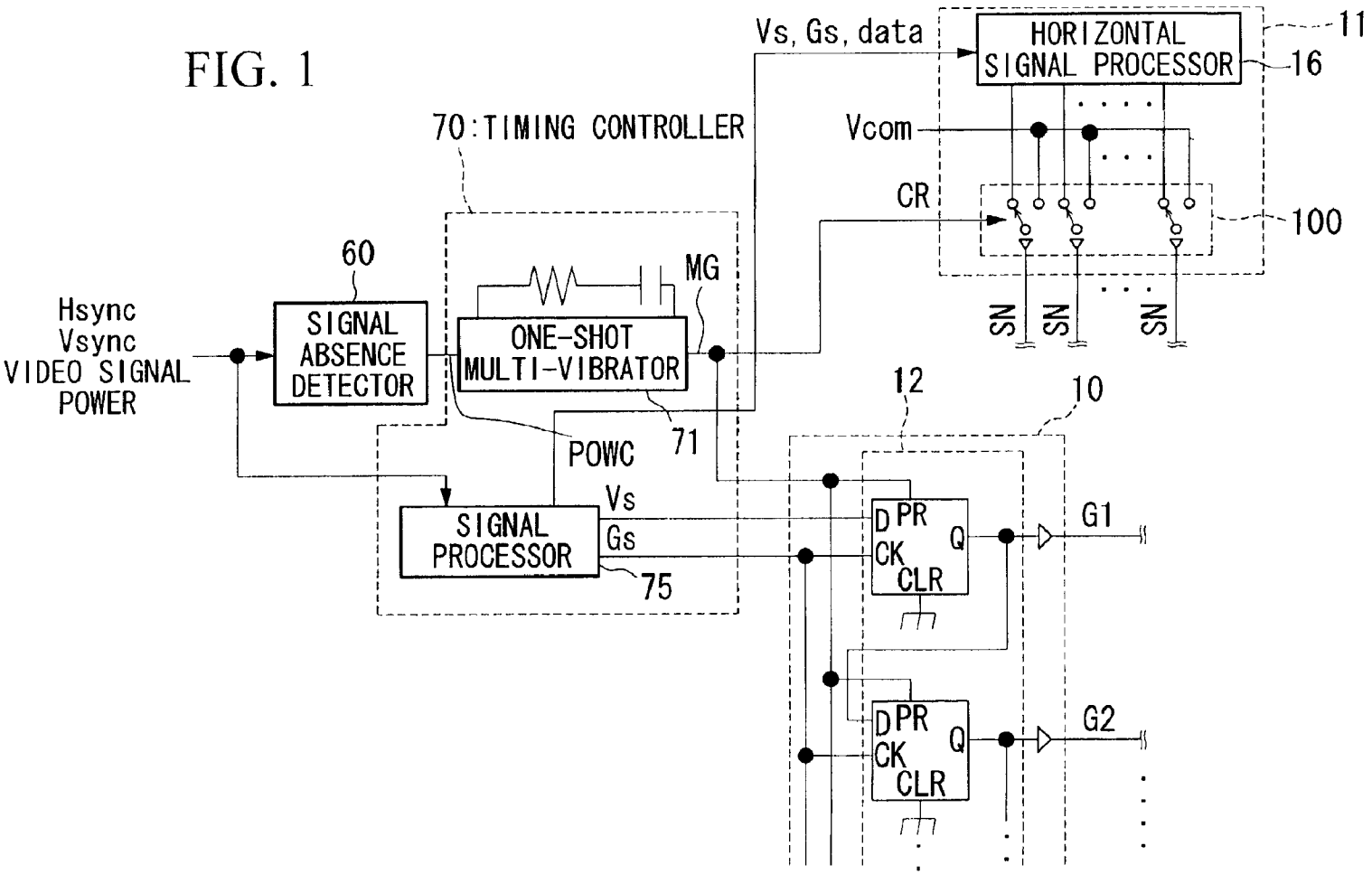
FIG. 1 is a block diagram showing the structure of the liquid crystal display device of the embodiment of the present invention.

The operation of the liquid crystal display device having the above-described structure will be explained with reference to FIGS. 1 to 3. FIG. 1 shows the internal structures of the respective sections shown in FIG. 2. FIG. 3 is a timing chart showing waveforms output from the respective sections as shown in FIG. 1.

In FIG. 1, the synchronizing signals (the horizontal synchronizing signal, and the vertical synchronizing signal), the video data ("data"), and a power source signal, which are output from the external device, are input to a signal absence detecting circuit 60, and to a signal processor 75 which are contained in the video signal processor 20 (see FIG. 2). The signal absence detecting circuit 60 detects the presence or absence of the input signals, outputs a signal at the H level when receiving the signal, and outputs a signal at the L level when receiving no signal. In this case, because the synchronizing signals are input, the output is at the H level (as shown in FIG. 3C).

Figures 3A, 3B, 3C, 3D, 3E, 3F:
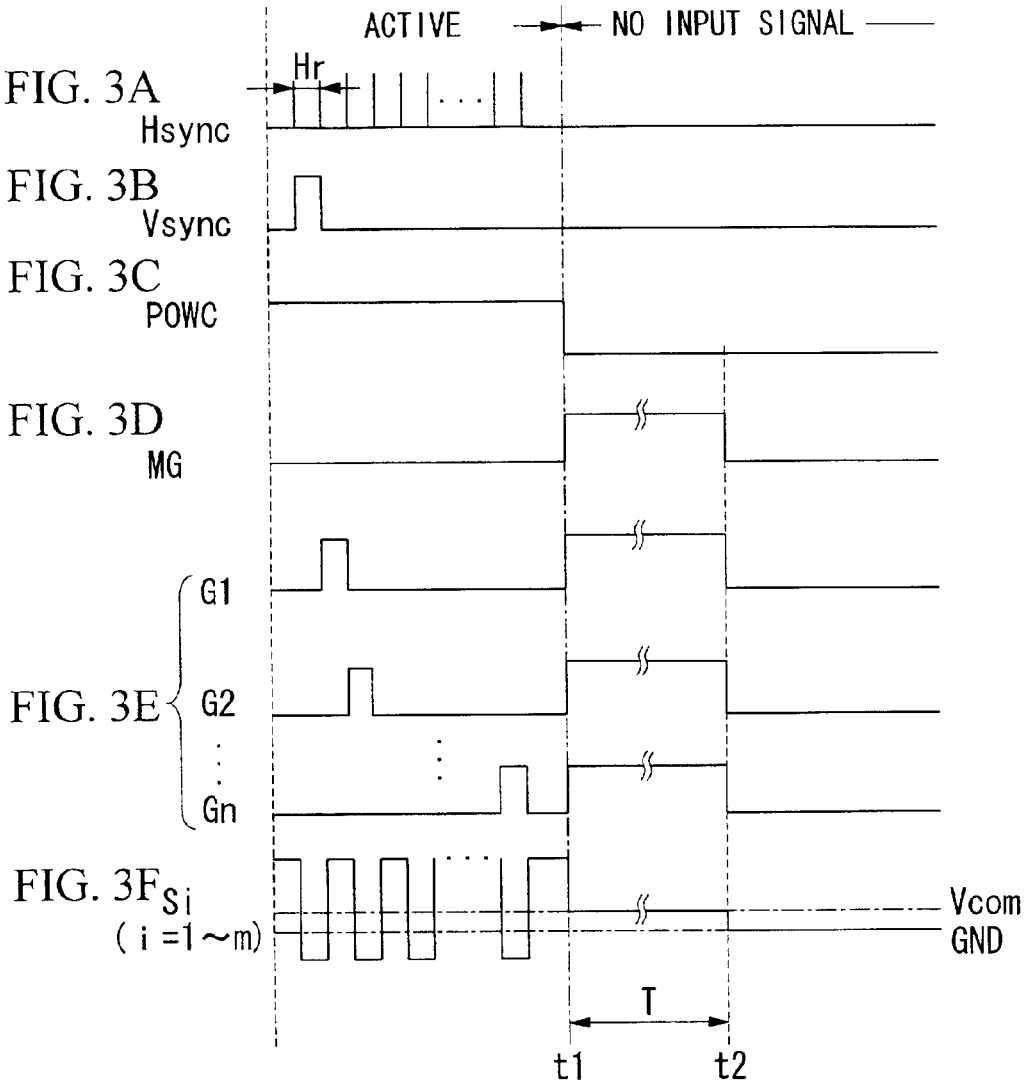
FIGS. 3A to 3F are timing charts showing the operations of the respective sections in the liquid crystal display device of the present invention.

The signal processor 75 generates frame pulses Fs, a vertical scanning timing signal Vs, and a gate line driving signal Gs, from the horizontal synchronizing signal (FIG. 3A), and the vertical synchronizing signal (FIG. 3B). The frame pulse Fs is produced whenever one screen image is displayed, and is specified according to the format of the video data. The vertical scan timing signal Vs is a pulse which is produced whenever the screen is vertically scanned. In one frame, the vertical scanning is repeated at a regular interval. The gate line driving signals Gs indicate the timings for driving the gate lines G1 to Gn. The number of the gate line driving signals GS are the same as the number "n" of the scanning lines G1 to Gn in one vertical scanning period.

The gate line driving signal Gs, which has been produced by signal processor 75, is supplied to a clock CK of a shift register 12 in the gate driver 10. The vertical scanning timing signal Vs is supplied to data D of the shift register 12. The shift register 12 drives one by one the gate lines G1, G2, . . . , Gn, based on the signals supplied from the signal processor 75 (FIG. 3E). The shift register 12 comprises flip-flops which are connected in series.

The signal processor 75 produces the video signal data corresponding to the unit pixels, from the input video signal, and supplies it together with the vertical scanning timing signal Vs and the gate line driving signal Gs to a horizontal signal processor 16 in the source driver 11. The horizontal signal processor 16 produces the data line driving signal DS for driving the data lines S1 to Sm, based on the vertical scanning timing signal Vs, the gate line driving signal Gs, and the video signal data, and drives the respective data lines S1 to Sm, based on the data line driving signal Ds.

An output switching circuit 100 switches the path for supplying the signals to be supplied to the data lines S1 to Sm. The output switching circuit 100 is controlled by a pulse signal MG output from a one-shot multi-vibrator 71 in a timing controller 70. The output switching circuit 100 connects all the data lines S1 to Sm to the horizontal signal processor 16.

As described above, when driving the gate lines G1 to Gn, the thin film transistors 72 provided in the unit pixels of the display panel 50, as shown in FIG. 3, are turned on one by one, so that the signals are supplied through the data lines 80 to the pixel electrodes 74. Thus, the voltage corresponding to the video signal is applied to the liquid crystal capacitance CL so that the orientation of the liquid crystal molecules is changed, providing a desired gradation.

The operation when the user turns off the liquid crystal display device after the above-described normal operation, and when no signal has been input will be explained. The liquid crystal display device of the embodiment turns off the input signal after receiving the user request to turn off the liquid crystal display device, and do not shut down the power supply.

When no signal has been input to the liquid crystal display device, the signal absence detecting circuit 60 detects that the no signal has been input for a predetermined period, for example, a period longer than the period of the horizontal synchronizing signal ("Hr" in FIG. 3A), and outputs a determination signal POWC at the L level at the time t1 (see FIG. 3C) to the one-shot multi-vibrator 71. On reception of the determination signal POWC at the L level, the one-shot multi-vibrator 71 outputs the pulse signal MG having the pulse width equal to the period T (FIG. 3D). The pulse signal MG is supplied to a preset PR of the shift register 12 in the gate driver 10, and is supplied to the output switching circuit 100 in the source driver 11. The pulse width T of the pulse signal MG is sufficiently long to discharge the charge from the liquid crystal capacitance CL provided in the unit pixel, and is predetermined by the capacitor and the resistance in the one-shot multi-vibrator 71.

When the pulse signal MG at the H level is input to the preset PR of the shift register 12, the shift register 31 outputs the signal at the H level to all the gate lines G1 to Gn. This condition is maintained until the time t2 at which point the pulse signal MG is decreased.

In response to the input pulse signal MG at the H level, the output switching circuit 100 switches the path, for supplying the input signals to the data lines S1 to Sm, from the horizontal signal processor 16 to the common electric potential Vcom. Accordingly, at the time t1, all the data lines S1 to Sm is fixed to the common electric potential Vcom (FIG. 3F).

Thus, in the unit pixel (FIG. 4), the gate line 82 becomes active so that the thin film transistor 72 is turned on. The common electric potential Vcom applied to the data line 80 is supplied to the pixel electrode 74, and the charge stored in the liquid crystal capacitance CL and the combined capacitances C1 and C2 is discharged through the data line 80. The operation is performed at the same time in all the unit pixels.

At the time t2, when the pulse signal MG becomes the L level, the shift register 12 turns off all the active gate lines G1 to Gn. Thus, the thin film transistor 72 of the unit pixel is turned off.

The output switching circuit 100 switches the path for supplying the input signals to the data lines S1 to Sm, from the common electric potential Vcom to the horizontal signal processor 16. At this time, because the signals such as the synchronizing signal is not input, the data lines are not driven even when the path is switched to the horizontal signal processor 16, and is connected to the ground.

It requires approximately 40 msec. from the point at which the input of the horizontal synchronizing signal Hsync and the vertical synchronizing signal Vsync is stopped, to the time t1 at which the signal absence detecting circuit 60 determines that no signal has been input, that is, from the point at which the input signals are turned off to the point at which the determination signal POWC at the L level is output.

Figure 6:
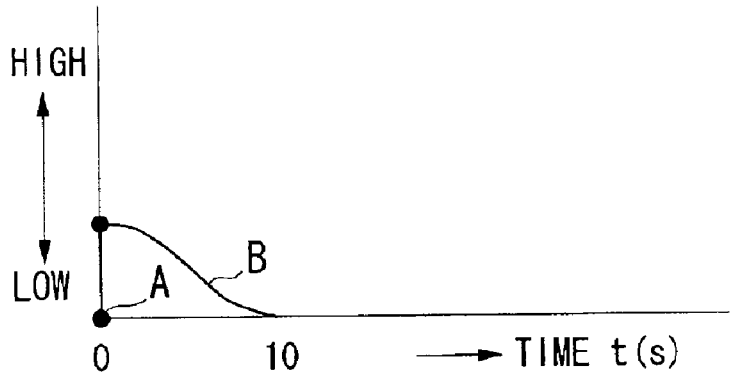
FIG. 6 is a diagram showing the effects of the present invention.
Figure 7A:
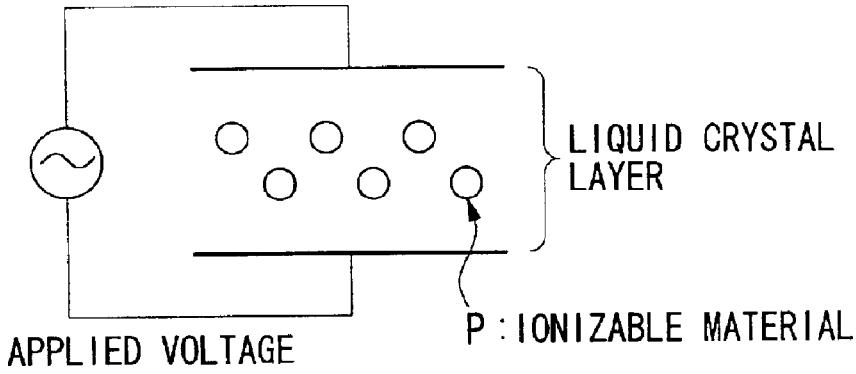
FIGS. 7A and 7B are diagrams for explaining the occurrence of an afterimage.
Figure 7B:
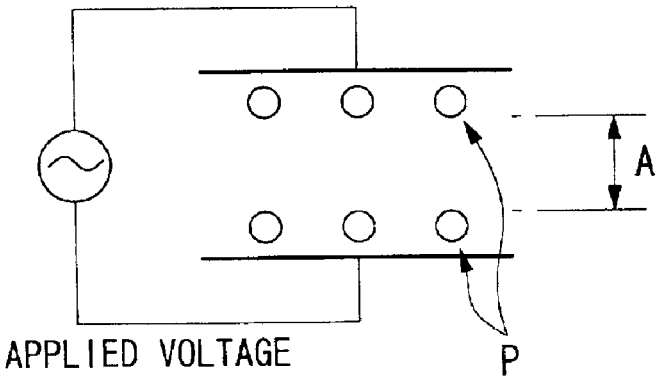

FIG. 6 shows the decay of the charge stored in the liquid crystal in the liquid crystal display device of the present invention applied to the factory automation and in the conventional liquid crystal display device applied to the factory automation. In FIG. 6, the horizontal axis represents a time (decay time), and the vertical axis represents the strength of the charge stored in the liquid crystal capacitance. Reference character A denotes the change of the charge in the liquid crystal display device of the present invention. Reference character B denotes the change of the charge in the conventional liquid crystal display device. In the present invention, the time required for the decay of the charge is below 0.5 seconds, whereas in the conventional liquid crystal display device, the time required for the decay of the charge is approximately 10 seconds.

As is obvious from FIG. 6, the liquid crystal display device of the present invention significantly shortens the time of charging up the liquid crystal as compared with the conventional liquid crystal display device, thereby preventing the afterimage. As the result, the quality of the liquid crystal display device is improved, and the reliability in use for years.

In the embodiment, only the input signals are turned off, and the power supply is not turned off when shutting down the device. A power supply maintaining circuit may be provided, and the present invention can be applied to the case in which the power supply is finally turned off.

In this case, even after the power supply has been turned off, the power supply maintaining circuit supplies the power for a time sufficient to discharge the charge from the liquid crystal capacitance CL of the unit pixel.

For example, between the times t1 and t2 in FIGS. 3A to 3F, when the power supply is turned off, the power supply maintaining circuit supplies the power to the gate driver 10, the timing controller 70, and the source driver 11. Thus, the operation for discharging the charge from the liquid crystal capacitance CL can be maintained.

When the power supply maintaining circuit supplies the power, the power may not be supplied to the source driver 11, and the data lines S1 to Sm may be connected to GND, so that the charge stored in the liquid crystal capacitance CL is discharged. That is, since the power supply is turned off, the common electric potential is GND. Accordingly, when connecting the data lines to the GND, the electric potential of the common electrode is applied to the data lines, and the charge stored in the liquid crystal capacitance can be discharged.

While the embodiment is described by way of the IPS type liquid crystal display device, the liquid crystal panel is not limited to this, and the same effects can be achieved in liquid crystal devices having different structures.

This invention may be embodied in other forms or carried out in other ways without departing from the spirit thereof. The present embodiments are therefore to be considered in all respects illustrative and not limiting, the scope of the invention being indicated by the appended claims, and all modifications falling within the meaning and range of equivalency are intended to be embraced therein.

What is claimed is:

1. A liquid crystal display device comprising:

pixel electrodes;

a common electrode;

a plurality of data lines and a plurality of gate lines intersecting each other;

a plurality of switchers, provided for the pixel electrodes, for supplying signals from the data lines to the pixel electrodes;

a gate line driver for scanning the gate lines;

a data line driver for driving the data lines, in accordance with the gradation to be displayed; and a controller for controlling the gate line driver and the data line driver, wherein the controller comprises a signal absence detector for detecting that at least one of a video signal, a horizontal synchronization signal, and a vertical synchronization signal is no longer being input to the liquid crystal display device, wherein in response to a detection by the signal absence detector that one of the signals is no longer being input while power is being supplied to the liquid crystal display, the controller outputs a signal to the gate line driver to make all the gate lines active for a predetermined time and the controller outputs a signal to the data line driver to supply the same electric potential as applied to the common electrode to all the data lines for the predetermined time, wherein, after discharging of the liquid crystal display, the controller outputs signals to the gate line driver and the data line driver for making the gate line driver and the data line driver return to a state before the discharging was performed, and wherein the predetermined time, during which time all the gate lines are active and during which time the same electric potential as applied to the common electrode is applied to all the data lines, is determined based on time constants of a resistor and a capacitor.

2. A liquid crystal display device according to claim 1, wherein the predetermined time is a time required to discharge all the charge from the liquid crystal by supplying the common electric potential to all the pixel electrodes.

3. A liquid crystal display device according to claim 1, further comprising a power supply maintaining circuit for maintaining power after a power supply to the liquid crystal display device is turned off.

4. A liquid crystal display device according to claim 1, wherein the data line driver connects all the data lines to the ground after a power supply to the liquid crystal display device is turned off.

5. The device of claim 1, wherein said signal absence detector detects that at least one of a video signal and a vertical synchronization signal is no longer being input to the liquid crystal display device.

6. The device of claim 1, wherein said signal absence detector detects that a video signal is no longer being input to the liquid crystal display device.

7. The device of claim 1, wherein said signal absence detector detects that a vertical synchronization signal is no longer being input to the liquid crystal display device.

8. A method for controlling a liquid crystal display device comprising: pixel electrodes; a common electrode; a plurality of data lines and a plurality of gate lines intersecting each other; a plurality of switchers, provided for the pixel electrodes, for supplying signals from the data lines to the pixel electrodes; a gate line driver for scanning the gate lines; a data line driver for driving the data lines, in accordance with the gradation to be displayed; and a controller for controlling the gate line driver and the data line driver, the method comprising the steps of:

detecting that at least one of a video signal, a horizontal synchronization signal, and a vertical synchronization signal is no longer being input to the liquid crystal display device;

in response to detection that one of the signals is no longer being input to the liquid crystal display device while power is being supplied to the liquid crystal display, making all the gate lines active for a predetermined time and supplying the same electric potential as applied to the common electrode to all the data lines for the predetermined time, wherein the predetermined time, during which time all the gate lines are active and during which time the same electric potential as applied to the common electrode is applied to all the data lines, is determined based on time constants of a resistor and a capacitor, and after discharging of the liquid crystal display, outputting signals to the gate line driver and the data line driver for making the gate line driver and the data line driver return to a state before the discharging is performed.

9. The method of claim 8, wherein the detecting step detects that at least one of a video signal and a vertical synchronization signal is no longer being input to the liquid crystal display device.

10. The method of claim 8, wherein the detecting step detects that a video signal is no longer being input to the liquid crystal display device.

11. The method of claim 8, wherein the detecting step detects that a vertical synchronization signal is no longer being input to the liquid crystal display device.

* * * * *

UNITED STATES PATENT AND TRADEMARK OFFICE

CERTIFICATE OF CORRECTION

PATENT NO. : 6,961,034 B2
APPLICATION NO. : 09/767149
DATED : November 1, 2005
INVENTOR(S) : Tomohiro Kusanagi It is certified that error appears in the above-identified patent and that said Letters Patent is hereby corrected as shown below:

IN THE TITLE at (54), and also at Column 1, Line 1:

Delete "LIQUID CRYSTAL DISPLAY DEVICE FOR PREVENTING AND AFTERIMAGE" and replace with "LIQUID CRYSTAL DISPLAY DEVICE FOR PREVENTING AN AFTERIMAGE". The title should not include the word "AND" but should instead include the word "AN".

Signed and Sealed this
Twelfth Day of July, 2011

David J. Kappos

David J. Kappos
*Director of the United States Patent and Trademark Office*